US009099019B2

(12) United States Patent
Jang

(10) Patent No.: US 9,099,019 B2
(45) Date of Patent: Aug. 4, 2015

(54) IMAGE DISPLAY DEVICE, IMAGE DISPLAY SYSTEM, AND METHOD FOR ANALYZING THE EMOTIONAL STATE OF A USER

(75) Inventor: Seungjin Jang, Gyeonggi-do (KR)

(73) Assignee: LG ELECTRONICS INC., Seoul (KR)

( * ) Notice: Subject to any disclaimer, the term of this patent is extended or adjusted under 35 U.S.C. 154(b) by 188 days.

(21) Appl. No.: 13/816,439

(22) PCT Filed: Aug. 12, 2010

(86) PCT No.: PCT/KR2010/005294

§ 371 (c)(1),
(2), (4) Date: Feb. 11, 2013

(87) PCT Pub. No.: WO2012/020861

PCT Pub. Date: Feb. 16, 2012

(65) Prior Publication Data

US 2013/0135176 A1 May 30, 2013

(51) Int. Cl.

| | |
|---|---|
| ***G09G 5/00*** | (2006.01) |
| ***G09G 3/00*** | (2006.01) |
| ***H04H 60/33*** | (2008.01) |
| ***H04H 60/45*** | (2008.01) |
| ***H04H 60/61*** | (2008.01) |

(52) U.S. Cl.

CPC ..... *G09G 3/001* (2013.01); *H04H 60/33* (2013.01); *H04H 60/45* (2013.01); *H04H 60/61* (2013.01)

(58) Field of Classification Search

CPC ..... H04H 60/33; H04H 60/45; H04H 60/61

USPC ..... 345/156

See application file for complete search history.

(56) References Cited

U.S. PATENT DOCUMENTS

| | | | | |
|---|---|---|---|---|
| 2010/0088088 | A1* | 4/2010 | Bollano et al. | 704/201 |
| 2011/0207100 | A1* | 8/2011 | Brokken et al. | 434/236 |

FOREIGN PATENT DOCUMENTS

| | | |
|---|---|---|
| JP | 2005-142975 | 6/2005 |
| JP | 2008-258733 | 10/2008 |
| KR | 10-2004-0054774 | 6/2004 |
| KR | 10-2006-0021544 | 3/2006 |
| KR | 10-2008-0072085 | 8/2008 |

* cited by examiner

*Primary Examiner* — Viet Pham

(74) *Attorney, Agent, or Firm* — Lee, Hong, Degerman, Kang & Waimey

(57) ABSTRACT

The present invention relates to an image display device, to an image display system, to a method for analyzing the emotional state of user, wherein information on a user response to a scene containing content is analyzed so as to provide a user with information on the emotional state of the user for the scene or to selectively provide information added for each scene of the content, thereby rendering an interactive service. According to one embodiment of the present invention, the method for analyzing the emotional state of a user comprises the steps of: outputting a scene comprising content having identification information; receiving information on a user response to the scene; determining the emotional state of the user for the scene on the basis of the information on the user response; and storing the determined emotional state in association with the identification information.

20 Claims, 10 Drawing Sheets

FIG. 6
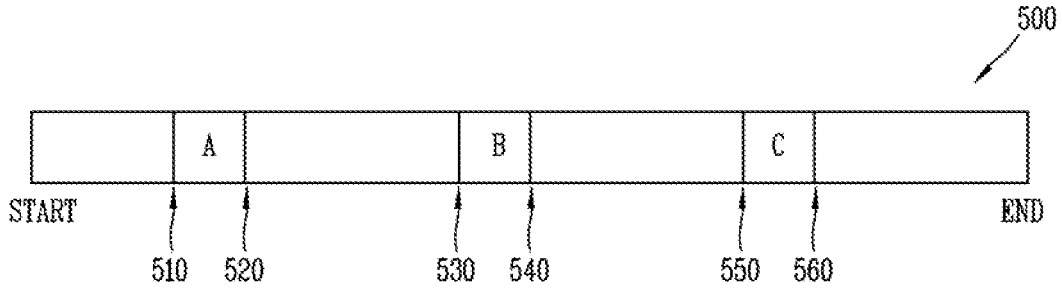
FIG. 7
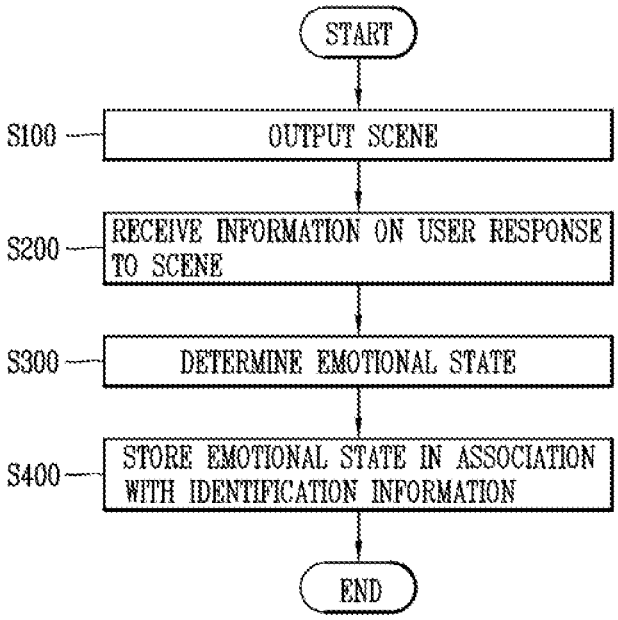
FIG. 8
600
| IDENTIFICATION | TIME STAMP | EMOTIONAL STATE |
|---|---|---|
| A | 00:12:00~00:13:30 | RELAXED |
| B | 00:50:00~00:55:00 | TIRED |
| C | 01:20:00~01:30:00 | EXCITED |
610 620 630

IMAGE DISPLAY DEVICE, IMAGE DISPLAY SYSTEM, AND METHOD FOR ANALYZING THE EMOTIONAL STATE OF A USER

CROSS-REFERENCE TO RELATED APPLICATIONS

This application is the National Stage filing under 35 U.S.C. 371 of International Application No. PCT/KR2010/005294, filed on Aug. 12, 2010, the contents of which are all hereby incorporated by reference herein in their entirety.

TECHNICAL FIELD

The present invention relates to an image display device, an image display system, and a method for analyzing an emotional state of a user, and more particularly, to an image display device having a function for outputting content, an image display system and a method for analyzing an emotional state of a user.

BACKGROUND ART

As techniques of digital broadcasting, network and multimedia develop recently, users can appreciate various types of content.

DISCLOSURE OF THE INVENTION

Therefore, an object of the present invention is to provide an image display device, an image display system, and a method for analyzing an emotional state of a user, wherein information on a user response to a scene included in content is analyzed so as to provide a user with information on an emotional state of the user for the scene, or to selectively provide information added for each scene of the content, thereby rendering an interactive service.

To achieve these and other advantages and in accordance with the purpose of the present invention, as embodied and broadly described herein, there is provided a method for analyzing an emotional state of a user, in an image display device, the method comprising: outputting, from content, a scene having identification information; receiving information on a user response to the scene; determining an emotional state of the user for the scene on the basis of the information on the user response; and storing the determined emotional state in association with the identification information.

According to an embodiment of the present invention, the method may further include outputting the determined emotional state, and/or transmitting the determined emotional state to a mobile terminal. The step of outputting the determined emotional state and/or transmitting the determined emotional state to a mobile terminal may include: checking an output setting and/or a transmission setting about an emotional state; and outputting the determined emotional state, and/or transmitting the determined emotional state to the mobile terminal, based on the output setting and/or the transmission setting.

According to an embodiment, the scene may be connected to additional information associated with the scene, and the method may further include outputting the additional information, and/or transmitting the additional information to the mobile terminal based on the determined emotional state. According to an embodiment, the step of outputting the additional information and/or transmitting the additional information to the mobile terminal, may include: checking an output setting and/or a transmission setting about additional information; and outputting the additional information and/or transmitting the additional information to the mobile terminal, based on the output setting and/or the transmission setting, and based on the determined emotional state. According to an embodiment, the additional information may be content associated with the scene, or information on the scene. According to an embodiment, the content associated with the scene, or the information on the scene may be advertisement content, or scene information.

According to an embodiment, the information on a user response may include at least one of information on a user's visual response and information on a user's audible response. According to an embodiment, the information on a user response may include at least one of a user's skin temperature, a skin conductance, heartbeat variations and a brain wave signal. According to an embodiment, in the step of receiving information on a user response, information on a user response may be received from a remote controller of the user.

According to an embodiment, the step of determining an emotional state of the user for the scene may include: determining the degree of pleasure, displeasure, arousal-high and arousal-low of the user, based on the information on a user response; and determining an emotional state of the user for the scene, based on the determined degree of pleasure, displeasure, arousal-high and arousal-low of the user.

According to an embodiment, the identification information added to the scene may include information on a time stamp of the scene.

According to an embodiment, the method may further comprise: generating taste information of the user based on the determined emotional state and the identification information; and storing the generated taste information.

To achieve these and other advantages and in accordance with the purpose of the present invention, as embodied and broadly described herein, there is also provided an image display device, comprising: an output unit configured to output, from content, a scene having identification information; a communication unit configured to receive information on a user response to the scene; and a controller configured to determine an emotional state of the user for the scene on the basis of the information on the user response, and configured to store the determined emotional state in association with the identification information.

To achieve these and other advantages and in accordance with the purpose of the present invention, as embodied and broadly described herein, there is still also provided an image display system, comprising: a remote device; and an image display device, wherein the image display device comprises: an output unit configured to output, from content, a scene having identification information; a communication unit configured to receive, from the remote device, information on a user response to the scene; and a controller configured to determine an emotional state of the user for the scene on the basis of the information on the user response, and configured to store the determined emotional state in association with the identification information, wherein the remote device is configured to transmit, to the image display device, the information on the user response to the scene.

The present invention may have the following advantages.

Firstly, the image display device can analyze and store an emotional state for a scene, the emotional state included in content. Accordingly, a content provider can intuitively receive a user's feedback according to a content characteristic for each scene, and can selectively provide a service added for each scene. Further, a user can check his or her emotional state according to a content characteristic for each scene, and can receive a customized service according to his or her emotional state without an additional operation.

BRIEF DESCRIPTION OF THE DRAWINGS

FIG. 6 is a view showing a content structure according to an embodiment of the present invention;

FIG. 7 is a flowchart showing processes for analyzing an emotional state of a user according to an embodiment of the present invention;

FIG. 8 is a view showing an emotional state recording table according to an embodiment of the present invention;

MODES FOR CARRYING OUT THE PREFERRED EMBODIMENTS

Reference will now be made in detail to the preferred embodiments of the present invention, examples of which are illustrated in the accompanying drawings. It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

Description will now be given in detail of a drain device and a refrigerator having the same according to an embodiment, with reference to the accompanying drawings.

Hereinafter, an image display device, an image display system, and a method for analyzing an emotional state of a user according to an embodiment of the present invention will be explained in more detail with reference to FIGS. 1 to 15.

Image Display System

Figure 1:
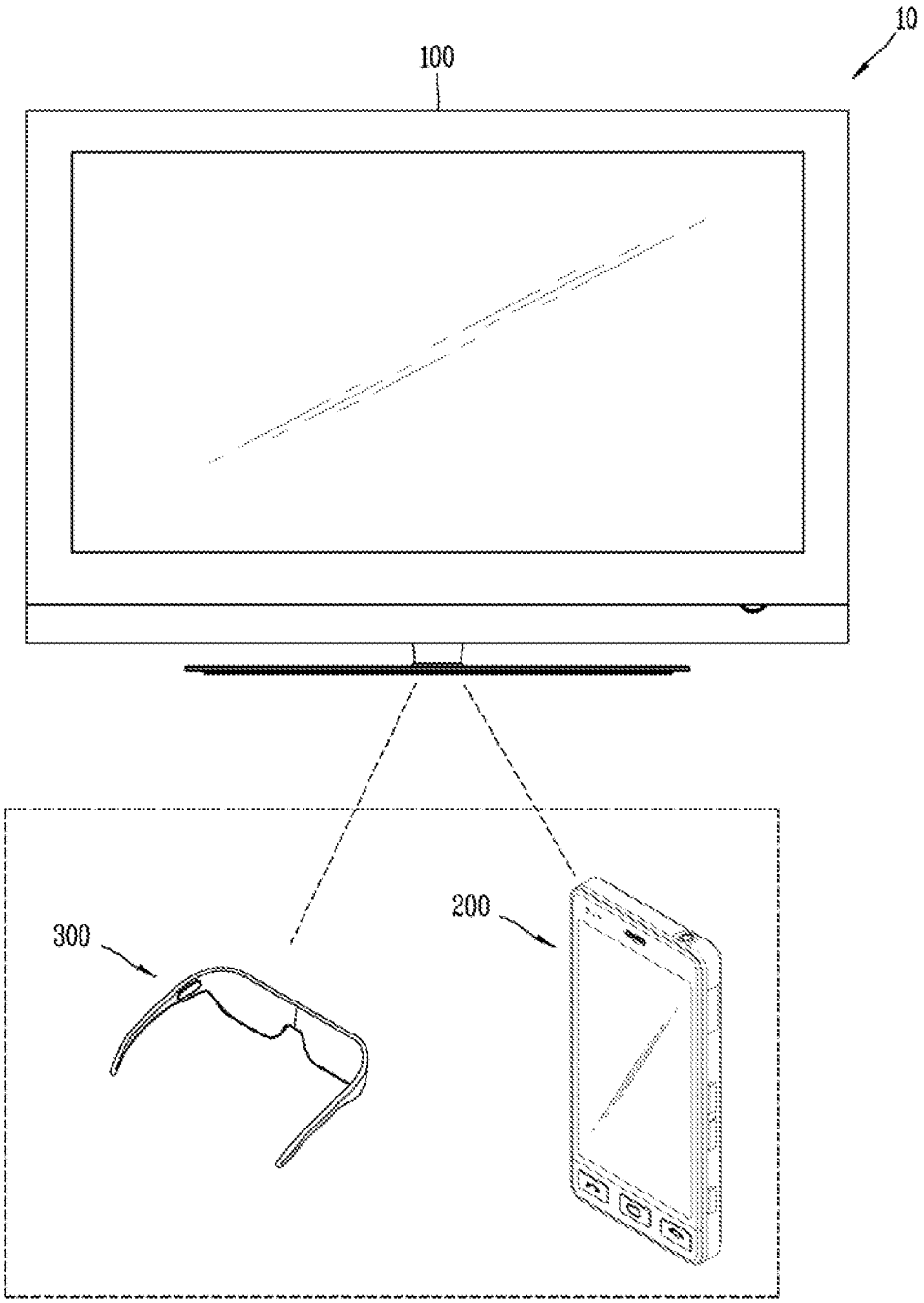
FIG. 1 is a view showing an image display system according to an embodiment of the present invention.

FIG. 1 is a view showing an image display system according to an embodiment of the present invention. Referring to FIG. 1, the image display system 10 includes an image display device 100, a mobile terminal 200, and a signal measuring unit 300.

The image display device 100 may receive broadcasting signals including video signals received from a broadcasting station. The image display device 100 may process video signals, audio signals or data signals included in the broadcasting signals, so that the signals can be output from the image display device 100. The image display device 100 may output video or audio signals based on the processed video signals.

The image display device 100 may communicate with a network server. The network server is a device for transmitting and receiving (transceiving) signals with the image display device 100 through any network. For instance, the network server may be a mobile terminal which can be connected to the image display device 100 through a wired or wireless base station. Alternatively, the network server may be a device which can provide content to the image display device 100 through an Internet network. The content provider may provide content to the image display device 100 using a network server.

The image display device 100 may communicate with the mobile terminal 200 and the signal measuring unit 300. The mobile terminal 200 and the signal measuring unit 300 may directly transceive signals with the image display device 100 in a wired or wireless manner.

The mobile terminal 200, a broadcasting station or a network server may transmit signals including video signals, to the image display device 100. The image display device 100 may display images based on the video signals included in the received signals. The image display device 100 may transmit, to the mobile terminal 200, signals transmitted thereto from a broadcasting station or a network server. The image display device 100 may transmit signals transmitted thereto from the mobile terminal 200, to a broadcasting station or a network server. That is, the image display device 100 may not only directly reproduce content included in signals transmitted from the broadcasting station, the network server and the mobile terminal 200, but also transmit the content.

According to an embodiment of the present invention, the image display device 100 outputs, from content, a scene having identification information. The signal measuring unit 300 generates information associated with a user response to a scene, and transmits the information associated with a user response, to the image display device 100. The image display device 100 receives the information associated with the user response, and determines an emotional state of the user for the scene, based on the received information. The image display device 100 stores the determined emotional state in association with the identification information added to the scene.

Image Display Device

Figure 2A:
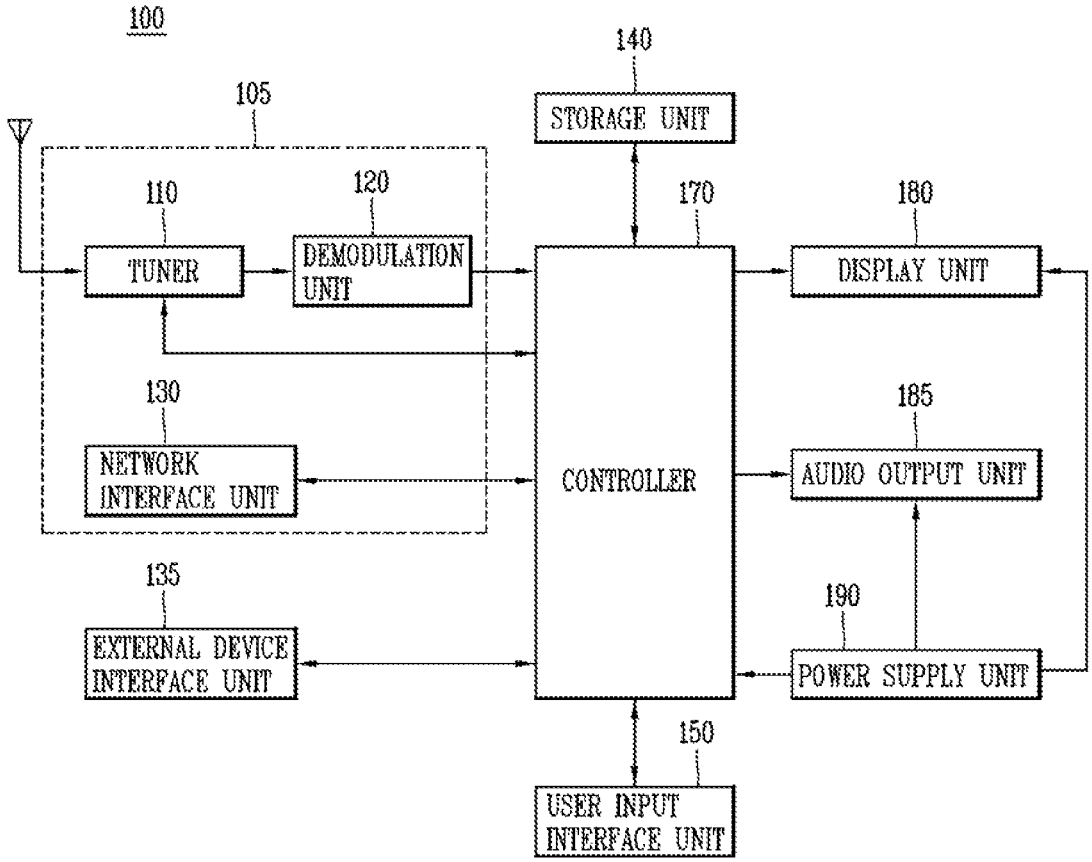
FIG. 2A is a block diagram of an image display device according to an embodiment of the present invention.

FIG. 2A is a block diagram of an image display device according to an embodiment of the present invention. Referring to FIG. 2A, the image display device 100 according to an embodiment of the present invention may include a broadcasting receiving unit 105, an external device interface unit 135, a storage unit 140, a user input interface unit 150, a controller 170, a display unit 180, an audio output unit 185, and a power supply unit 190. The broadcasting receiving unit 105 may include a tuner 110, a demodulation unit 120, and a network interface unit 130. The tuner 110 and the demodulation unit 120 may be provided, or the network interface unit 130 may be provided. The broadcasting receiving unit 105 may include a plurality of tuners 110.

The tuner 110 is configured to select, from radio frequency (RF) broadcasting signals received through an antenna, RF broadcasting signals corresponding to a channel selected by a user, or corresponding to all pre-stored channels. And, the tuner 110 is configured to convert the selected RF broadcasting signals, into intermediate frequency signals or baseband video signals or audio signals. For instance, if the selected RF broadcasting signals are digital broadcasting signals, the tuner 110 converts the selected RF broadcasting signals into digital IF signals (DIF). On the other hand, if the selected RF broadcasting signals are analogue broadcasting signals, the tuner 110 converts the selected RF broadcasting signals into analogue baseband video or audio signals (CVBS/SIF). That is, the tuner 110 may process digital broadcasting signals or analogue broadcasting signals. The analogue baseband video or audio signal (CVBS/SIF) output from the tuner 110 may be directly input to the controller 170.

The tuner 110 may receive RF broadcasting signals of a single carrier according to an ATSC (Advanced Television System Committee) method, or may receive RF broadcasting signals of a plurality of carriers according to a DVB (Digital Video Broadcasting) method. The tuner 110 may sequentially select RF broadcasting signals of all broadcasting channels stored by a channel memory function, among RF broadcasting signals received through an antenna, thereby converting the selected RF broadcasting signals into intermediate frequency signals or baseband video or audio signals.

The demodulation unit 120 receives digital IF signals (DIF) converted by the tuner 110, thereby demodulating the received DIF signals. For instance, if DIF signals output from the tuner 110 are ATSC signals, the demodulation unit 120 performs an 8-VST (Vestigal Side Band) demodulation. The demodulation unit 120 may perform a channel decoding. To this end, the demodulation unit 120 may be provided with a trellis decoder, a deinterleaver, a reed solomon decoder, etc., thereby performing trellis decoding, deinterleaving and reed solomon decoding.

For instance, if DIF signals output from the tuner 110 are DVB signals, the demodulation unit 120 performs COFDMA (Coded Orthogonal Frequency Division Multiplexing), a modulation technique. The demodulation unit 120 may perform a channel decoding. To this end, the demodulation unit 120 may be provided with a convolution decoder, a deinterleaver, a reed solomon decoder, etc., thereby performing convolution decoding, deinterleaving and reed solomon decoding.

The demodulation unit 120 may output a stream signal (TS) after performing a demodulation and a channel decoding. The stream signal may be a signal implemented as video, audio, or data signals are multiplexed. For instance, the stream signal may be MPEG-2 TS (Transport Stream) where video signals of MPEG-2 standard, audio signals of Dolby AC-3 standard, etc. are multiplexed. More specifically, the MPEG-2 TS may include a header of 4 bytes, and a payload of 184 bytes.

The demodulation unit 120 may be individually provided according to an ATSC method and a DVB method. That is, the demodulation unit 120 may be implemented as an ATSC demodulation portion and a DVB demodulation portion.

Stream signals output from the demodulation unit 120 may be input to the controller 170. After performing demultiplexing, video/audio signal processing, etc., the controller 170 outputs video signals to the display unit 180 and outputs audio signals to the audio output unit 185.

The external device interface unit 135 may connect an external device to the image display device 100. To this end, the external device interface unit 135 may include an A/V input/output unit (not shown) or a wireless communication unit (not shown).

The external device interface unit 135 may be connected, in a wired or wireless manner, to an external device such as a digital versatile disk (DVD), a blue ray disk, a game device, a camera, a camcorder, and a computer (notebook). The external device interface unit 135 transmits, to the controller 170 of the image display device 100, video, audio or data signals input from the outside through a connected external device. The external device interface unit 135 may output, to the connected external device, video, audio or data signals processed by the controller 170. To this end, the external device interface unit 135 may include an A/V input/output unit (not shown) or a wireless communication unit (not shown).

The A/V input/output unit may include a USB terminal, a CVBS (Composite Video Banking Sync) terminal, a component terminal, an S-video terminal (analogue), a DVI (Digital Visual Interface) terminal, an HDMI (High Definition Multimedia Interface) terminal, an RGB terminal, a D-SUB terminal, etc.

The wireless communication unit may perform a short-range wireless communication with other electronic device. The image display device 100 may be connected to other electronic device via a network, according to communication standards such as Bluetooth, RFID (Radio Frequency Identification), IrDA (Infrared Data Association), UWB (Ultra Wideband), ZigBee, and DLNA (Digital Living Network Alliance).

The external device interface unit 135 is connected to various types of set top boxes via one of the aforementioned terminals, thereby performing input/output operations with the set top boxes. The external device interface unit 135 may receive applications in a neighboring external device or an application list, thereby transmitting the received applications or application list to the controller 170 or the storage unit 140.

The network interface unit 130 provides an interface for connecting the image display device 100 with a wired/wireless network including an Internet network. The network interface unit 130 may be provided with an Ethernet terminal, etc. for connection with a wired network. For connection with a wireless network, the network interface unit 130 may utilize communication standards such as WLAN (Wireless LAN) (Wi-Fi), Wibro (Wireless Broadband), Wimax (World Interoperability for Microwave Access), and HSDPA (High Speed Downlink Packet Access).

The network interface unit 130 may access a prescribed web page via a network. That is, the network interface unit 130 may access a prescribed web page via a network, thereby transmitting or receiving data to/from a corresponding server. Further, the network interface unit 130 may receive content or data provided from a content provider or a network operator. That is, the network interface unit 130 may receive content and related information such as films, advertisements, games, VODs and broadcasting signals provided from a content provider or a network operator via a network. Further, the network interface unit 130 may receive update information and update files of a firmware provided from a network operator. Also, the network interface unit 130 may transmit data to the Internet, or a content provider or a network operator.

The network interface unit 130 may select and receive a desired application via a network, among applications open to the air.

The storage unit 140 may store programs for processing and controlling various types of signals inside the controller 170, and may store processed video, audio, or data signals. The storage unit 140 may temporarily store video, audio, or data signals input from the external device interface unit 135 or the network interface unit 130. Further, the storage unit 140 may store information on a prescribed broadcasting channel, through a channel memory function. Further, the storage unit 140 may store applications or an application list input from the external device interface unit 135 or the network interface unit 130.

The storage unit 140 may include at least one type of storage medium among a flash memory type, a hard disk type, a multimedia card micro type, a card type memory (e.g., SD or XD memory), RAM and EEROM. The image display device 100 may reproduce content files stored in the storage unit 140 (moving image files, still image files, music files, document files, application files, etc.), and provide the reproduced content files to a user.

FIG. 2A shows an embodiment in which the storage unit 140 and the controller 170 are separately provided. However, the present invention is not limited to this. The storage unit 140 may be included in the controller 170.

The user input interface unit 150 transmits signals input from a user to the controller 170, or transmits signals input from the controller 170 to a user. Alternatively, the user input interface unit 150 may transmit, to the controller 170, user input signals or control signals input from a local key (not shown) such as a power key, a channel key, a volume key and a setting key.

Alternatively, the user input interface unit 150 may transmit, to the controller 170, user input signals or control signals input from a sensing unit (not shown) for sensing a user gesture. Alternatively, the user input interface unit 150 may transmit signals input from the controller 170, to the sensing unit (not shown). The sensing unit may include a touch sensor, an audio sensor, a position sensor, an operation sensor, etc.

The controller 170 may demultiplex streams input via the tuner 110 or the demodulation unit 120 or the external device interface unit 135, or processes demultiplexed signals, thereby generating and outputting video or audio signals.

Video signals processed by the controller 170 are input to the display unit 180, thereby being displayed as a corresponding image. Video signals processed by the controller 170 may be input to an external output device via the external device interface unit 135. Audio signals processed by the controller 170 may be output to the audio output unit 185. Audio signals processed by the controller 170 may be input to an external output device via the external device interface unit 135.

Although not shown, the controller 170 may include a demultiplexing unit, an image processing unit, etc.

The controller 170 may control the entire operations of the image display device 100. For instance, the controller 170 may control tuning of an RF broadcasting corresponding to a user's selection channel or a pre-stored channel, by controlling the tuner 110.

The controller 170 may control the image display device 100, according to a user command input through the user input interface unit 150, or according to an inner program. Especially, the controller 170 may control a user to download a desired application or application list into the image display device 100 by accessing a network.

As an example, the controller 170 controls the tuner 110, so that signals of a channel can be input, the channel selected according to a channel selection command received via the user input interface unit 150. And, the controller 170 processes video, audio or data signals of the selected channel. The controller 170 controls information on a channel selected by a user, etc., to be output to the display unit 180 or the audio output unit 185, together with processed video or audio signals.

As another example, the controller 170 controls video signals or audio signals applied from an external device input via the external device interface unit 135 (e.g., a camera or a camcorder), to be output to the display unit 180 or the audio output unit 185, according to an external device image reproducing command received via the user input interface unit 150.

The controller 170 may control the display unit 180 to display images. For instance, the controller 170 may control images to be displayed on the display unit 180, the images such as broadcasting images input via the tuner 110, external input images input via the external device interface unit 135, images input via the network interface unit, or images stored in the storage unit 140. The images displayed on the display unit 180 may be still images or moving images, and may be 2D images or 3D images.

When the image display device enters an application viewing item, the controller 170 may control display of applications or an application list, the applications which can be downloaded to the image display device 100 or downloaded from an external network.

The controller 170 may control installation and driving of applications downloaded from an external network, together with various types of user interfaces. Alternatively, the controller 170 may control images associated with an application being executed, to be displayed on the display unit 180 according to a user's selection.

Although not shown, may be further provided a channel browsing processing unit for generating a thumb nail image corresponding to a channel signal or an external input signal. The channel browsing processing unit may receive stream signals (TS) output from the demodulation unit 120, stream signals output from the external device interface unit 135, etc., and may extract images from the input stream signals to thus generate thumbnail images. The generated thumbnail images may be coded as it is to thus be input to the controller 170. Alternatively, the generated thumbnail images may be coded in the form of streams to thus be input to the controller 170. The controller 170 may display, on the display unit 180, a thumbnail list having a plurality of thumbnail images using the input thumbnail images. The thumbnail images in the thumbnail list may be updated sequentially or simultaneously. This can allow a user to conveniently check content of a plurality of broadcasting channels.

The display unit 180 converts video signals, data signals, and OSD signals processed by the controller 170, or video signals, data signals, etc. received from the external device interface unit 135, into R, G and B signals, respectively, thereby generating driving signals. The display unit 180 may be implemented as a PDP, an LCD, an OLED, a flexible display, a 3-dimensional (3D) display, etc. The display 180 may be implemented as a touch screen to thus be used as an input device rather than an output device.

The audio output unit 185 receives signals having undergone audio processing by the controller 170 (e.g., stereo signals, 3.1 channel signals, or 5.1 channel signals), thereby outputting the received signals as audio signals. The audio output unit 185 may be implemented as various types of speakers.

A capturing unit (not shown) for capturing a user may be further provided. The capturing unit (not shown) may be implemented as a single camera. However, the present invention is not limited to this. That is, the capturing unit may be implemented as a plurality of cameras. Information on images captured by the capturing unit is input to the controller 170.

A sensing unit (not shown) having at least one of a touch sensor, an audio sensor, a position sensor and an operation sensor, and configured to sense a user's gesture may be further provided at the image display device 100. Signals sensed by the sensing unit (not shown) may be transmitted to the controller 170 via the user input interface unit 150.

The controller 170 may sense a user's gesture by combining images captured by the capturing unit (not shown), with signals sensed by the sensing unit (not shown).

The power supply unit 190 supplies power to the entire components of the image display device 100. Especially, the power supply unit 190 may supply power, to the controller 170 which can be implemented as a system on chip (SOC), the display unit 180 for displaying images, and the audio output unit 185 for outputting audio signals.

To this end, the power supply unit 190 may be provided with a converter (not shown) for converting an AC power to a DC power. In a case where the display unit 180 is implemented as an LC panel having a plurality of backlight lamps, the power supply unit 190 may be further provided with an inverter (not shown) which can perform a PWM operation, for brightness change or dimming driving.

The image display device 100 may be implemented as a fixed digital broadcasting receiver configured to receive at least one of ATSC-type (8-VSB type) digital broadcasting, DVB-T type (COFDM type) digital broadcasting, ISDB-T type (BST-OFDM type) digital broadcasting, etc.

The image display device of the present invention may be a wireless type image display device excluding the display unit 180 and the audio output unit 185 of FIG. 2A, which transmits and receives data to/from the display unit 180 and the audio output unit 185 for wireless communication.

FIG. 2A is a block diagram of the image display device 100 according to an embodiment of the present invention. Components of the image display device 100 of FIG. 2A may be integrated with each other, or may be added or deleted according to the configuration of the image display device 100. That is, at least two components may be integrated as a single component, or a single component may be divided into two components. Functions performed by the respective components are merely for explanation about the present invention, and detailed operations or devices do not limit the scope of the present invention.

Unlike in FIG. 2A, the image display device 100 may not be provided with the tuner 110 and the demodulation unit 120 shown in FIG. 2A. The image display device 100 may be configured to receive image content via the network interface unit 130 or the external device interface unit 135, and to reproduce the received image content.

Figure 2B:
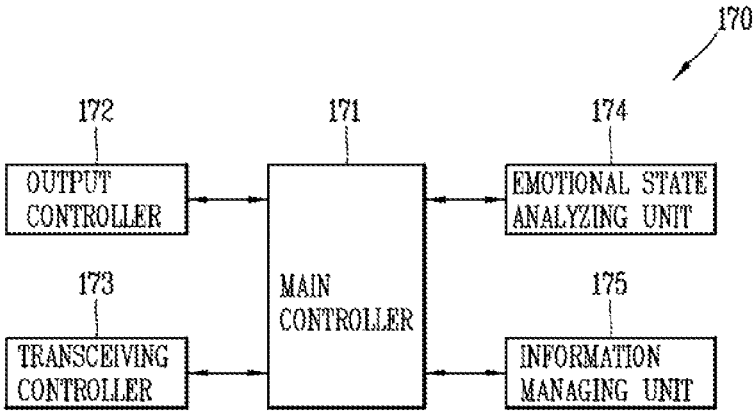
FIG. 2B is a detailed block diagram of a controller 170 of FIG. 2A.

FIG. 2B is a detailed block diagram of the controller 170 of FIG. 2A. The controller 170 includes a main controller 171, an output controller 172, a transceiving (transmitting/receiving) controller 173, an emotional state analyzing unit 174, and an information managing unit 175.

The main controller 171 is configured to control operations of other modules in the controller 170, and operations of the broadcasting receiving unit 105, the external device interface unit 135, the storage unit 140, the user input interface unit 150, the display unit 180, the audio output unit 185 and the power supply unit 190.

The output controller 172 is configured to control the overall operation associated with output of a scene included in content. Upon receipt of a request for output of a scene included in content, from the main controller 171, the output controller 172 may read the requested scene from the storage unit 140, or may receive the requested scene via the broadcasting receiving unit 105 or the external device interface unit 135. Then, the output controller 172 may output the read or received content to the display unit 180 and/or the audio output unit 185. The scene included in content may be a scene added with identification information.

The output controller 172 controls the entire operations associated with output of an emotional state of a user with respect to a scene being output, or output of additional information. Upon receipt of a request for output of an emotional state of a user for a scene being output, from the main controller 171, the output controller 172 may output the requested emotional state to the display unit 180 and/or the audio output unit 185. Upon receipt of a request for output of additional information added to a scene being output, from the main controller 171, the output controller 172 may output the requested additional information to the display unit 180 and/or the audio output unit 185.

The transmission/reception (transception) output controller 173 controls reception of information on an emotional state of a user with respect to a scene being output. Upon receipt of a request for information on a user response to a scene being output, from the main controller 171, the transception output controller 173 may output a control signal to the signal measuring unit 300 at certain time periods. Then, the transception output controller 173 may receive, from the signal measuring unit 300, information on a user response to a scene being output.

The transceiving controller 173 controls transmission of an emotional state of a user for a scene being output, or transmission of additional information. Upon receipt of a request for transmission of an emotional state of a user for a scene being output, from the main controller 171, the transceiving controller 173 may transmit the requested emotional state to the mobile terminal 200. Upon receipt of a request for transmission of additional information connected to a scene being output, from the main controller 171, the transceiving controller 173 may transmit the requested additional information to the mobile terminal 200.

The emotional state analyzing unit 174 determines an emotional state of a user, based on information on a user response to a scene being output, the information received from the signal measuring unit 300. For instance, the emotional state analyzing unit 174 receives information on a user's visual response (e.g., information on movement of a user's pupil) from the signal measuring unit 300, and determines an emotional state of the user based on the received information (e.g., information on recognition of an interesting object, the degree of concentration, etc.). Alternatively, the emotional state analyzing unit 174 receives information on a user's audible response (e.g., information on a user's voice) from the signal measuring unit 300, and determines an emotional state of the user based on the received information (e.g., usage of words, exclamations, sound pattern, etc.).

Still alternatively, the emotional state analyzing unit 174 may determine an emotional state of the user based on information measured from the signal measuring unit 300, the information including information on a skin temperature, information on skin conductance, information on heartbeat variations, and information on brain waves on the prefrontal. In this case, the emotional state of the user may be categorized into the degree of pleasure and displeasure, and the degree of arousal-high and arousal-low. The emotional state of the user may be expressed as a predefined emotional state, according to the degree of pleasure and displeasure and the degree of arousal-high and arousal-low. For instance, the emotional state of the user may be expressed as 'angry', 'delighted', 'relaxed', 'tired', etc.

The information managing unit 175 stores an emotional state of the user for a scene being output, in association with identification information on the scene being output. Upon receipt of a request for storage of an emotional state from the main controller 171, the information managing unit 175 receives identification information on a scene being output from the output controller 172, and receives an emotional state of the user for the scene being output from the emotional state analyzing unit 174. Further, the information managing unit 175 stores the emotional state received from the emotional state analyzing unit 174, in association with the identification information received from the output controller 172.

The information managing unit 175 may generate taste information of the user based on the determined emotional state and the identification information on the scene. Then, the information managing unit 175 may store the generated taste information of the user in the storage unit 140. In one embodiment, the taste information of the user is determined according to a genre of a scene being output, and the degree of satisfaction for a scene. The information managing unit 175 may determine a genre of a scene based on identification information for a scene being output, and may generate taste information of a user based on an emotional state for a scene being output.

Mobile Terminal

Figure 3:
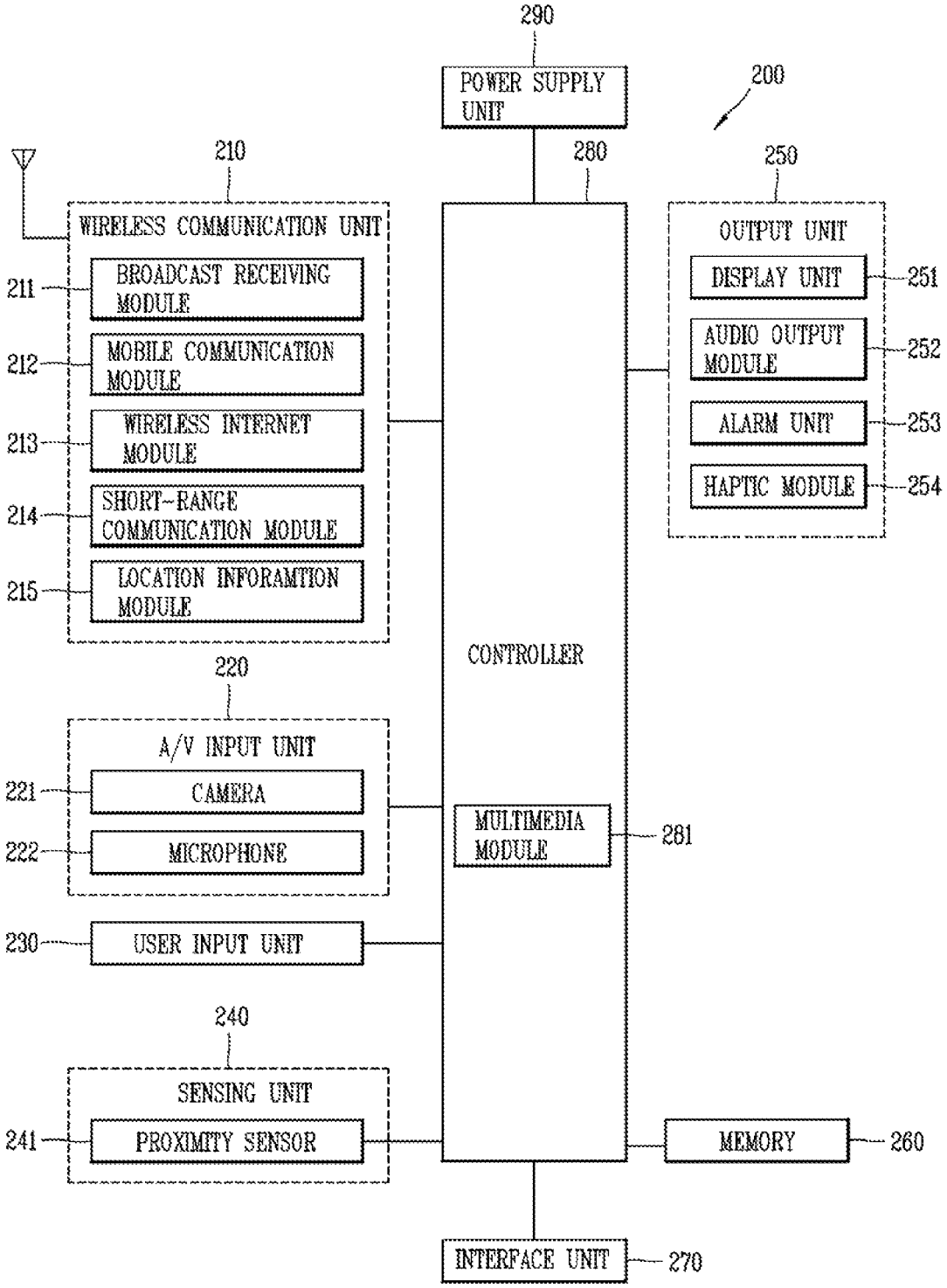
FIG. 3 is a block diagram of a mobile terminal according to an embodiment of the present invention.

FIG. 3 is a block diagram of a mobile terminal according to an embodiment of the present invention. The mobile terminal 200 according to one embodiment of the present invention may include a wireless communication unit 210, an A/V (Audio/Video) input unit 220, a user input unit 230, a sensing unit 240, an output unit 250, a memory 260, an interface unit 270, a controller 280, a power supply unit 290, etc.

The wireless communication unit 210 may include one or more components allowing radio communication between the mobile terminal 200 and a wireless communication system or a network in which the mobile terminal is located. For example, the wireless communication unit 210 may include a broadcasting receiving module 211, a mobile communication module 212, a wireless Internet module 213, a short-range communication module 214, a location information module 215, etc.

The broadcasting receiving module 211 receives broadcasting signals and/or broadcasting associated information from an external broadcasting management server (or other network entity) via a broadcasting channel. The mobile communication module 212 transmits and/or receives radio signals to and/or from at least one of a base station, an external terminal and a server. The wireless Internet module 213 indicates a module for wireless Internet access. This module may be internally or externally coupled to the mobile terminal 200. The short-range communication module 214 is a module for supporting short range communications. The location information module 215 is a module for acquiring a location (or position) of the mobile terminal. For example, the location information module 215 may include a GPS (Global Positioning System) module.

The A/V input unit 220 is configured to receive an audio or video signal. The A/V input unit 220 may include a camera 221, a microphone 222, etc.

The camera 221 processes image data of still pictures or video acquired by an image capture device in a video capturing mode or an image capturing mode. The processed image frames may be displayed on a display unit 251. The microphone 222 may receive sounds (audible data) via a microphone in a phone call mode, a recording mode, a voice recognition mode, and the like, and can process such sounds into electric audio data.

The user input unit 230 may generate input data for controlling the operation of the mobile terminal. The user input unit 230 may include a keypad, a dome switch, a touch pad (e.g., a touch sensitive member that detects changes in resistance, pressure, capacitance, etc. due to being contacted) a jog wheel, a jog switch, and the like.

The sensing unit 240 detects a current status (or state) of the mobile terminal 200 such as an opened or closed state of the mobile terminal 200, a location of the mobile terminal 200, the presence or absence of a user's touch (contact) with the mobile terminal 200, the orientation of the mobile terminal 200, an acceleration or deceleration movement and direction of the mobile terminal 200, etc., and generates sensing signals for controlling the operation of the mobile terminal 200.

The output unit 250 is configured to provide outputs in a visual, audible, and/or tactile manner. The output unit 250 may include the display unit 251, an audio output module 252, an alarm unit 253, a haptic module 254, and the like.

The display unit 251 may display information processed in the mobile terminal 200. The audio output module 252 may output audio data received from the wireless communication unit 210 or stored in the memory 260 in a call signal reception mode, a call mode, a record mode, a voice recognition mode, a broadcasting reception mode, and the like. The alarm unit 253 outputs a signal for informing about the occurrence of an event of the mobile terminal 200. The haptic module 254 generates various tactile effects the user may feel.

The memory 260 may store software programs used for the processing and controlling operations performed by the controller 280, or may temporarily store data (e.g., phonebook, messages, still images, moving images, etc.) that are inputted or outputted.

The interface unit 270 serves as an interface with every external device connected with the mobile terminal 200.

The controller 280 typically controls the general operations of the mobile terminal. The controller 280 may include a multimedia module 281 for reproducing multimedia data.

The power supply unit 290 receives external power or internal power and supplies appropriate power required for operating respective elements and components under the control of the controller 280.

According to one embodiment of the present invention, the controller 280 may receive, from the image display device 100, an emotional state of a user for a scene being output from the image display device 100, or additional information connected to a scene being output from the image display device 100, via the wireless communication unit 210 or the interface unit 270. The controller 180 may output, to the output unit 250, the emotional state or the additional information received from the image display device 100.

Signal Measuring Unit

Figure 4:
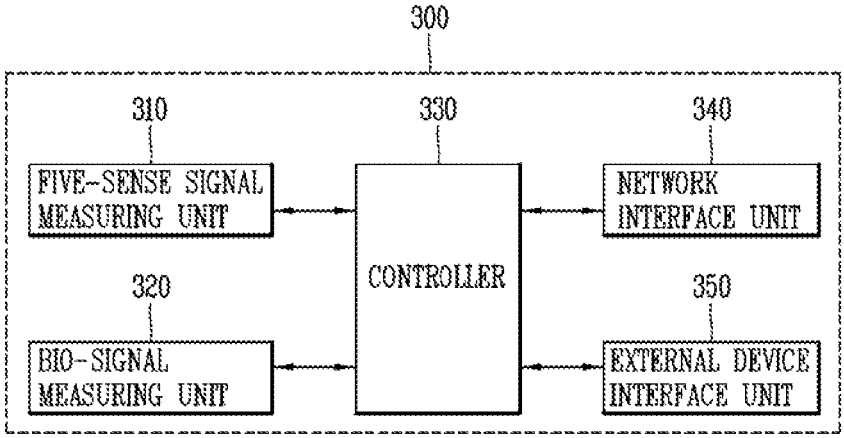
FIG. 4 is a block diagram of a signal measuring unit 300 according to an embodiment of the present invention.

FIG. 4 is a block diagram of the signal measuring unit 300 according to an embodiment of the present invention. The signal measuring unit 300 includes a five-sense signal measuring unit 310, a bio-signal measuring unit 320, a controller 330, a network interface unit 340, and an external device interface unit 350.

The five-sense signal measuring unit 310 includes an optical sensor (e.g., low-power CMOS camera) for measuring information on a user's visual response (movement of the pupils), and an audio sensor (e.g., microphone) for measuring information (sound, etc.) on a user's audible response.

The bio-signal measuring unit 320 includes a temperature sensor for measuring a skin temperature, etc. (e.g., thermometer), a skin conductance sensor for measuring a skin conductance through a skin resistance (e.g., galvanic skin resistance (GSR) sensor), a photoplethysmogram (PPG) sensor for indirectly measuring heartbeat variations, and an electroencephalogram (EEG) sensor for measuring brain waves on the prefrontal (region of the forehead). The bio-signal measuring unit 320 may further include a sensor for measuring oxygen saturation in blood, a sensor for measuring respirations, and a sensor for measuring an electromyogam of the facial muscle.

The controller 330 controls the operations of the five-sense signal measuring unit 310, the bio-signal measuring unit 320, the network interface unit 340, and the external device interface unit 350. The controller 330 measures a user's five-sense signals and/or bio-signals via the five-sense signal measuring unit 310 and/or the bio-signal measuring unit 320. And, the controller 330 generates information on a user response to a scene being output from the image display device 100, based on the measured signals.

For instance, the controller 330 amplifies signals measured by the five-sense signal measuring unit 310 and/or the bio-signal measuring unit 320, and converts the amplified signals into signals which can be transmitted to the image display device via the network interface unit 340 or the external device interface unit 350.

The network interface unit 340 provides an interface for connecting the signal measuring unit 300 to the image display device 100 through a wired/wireless network including an Internet network. The network interface unit 340 may be provided with an Ethernet terminal, etc. for connection with a wired network. For connection with a wireless network, the network interface unit 340 may utilize communication standards such as WLAN (Wireless LAN) (Wi-Fi), Wibro (Wireless Broadband), Wimax (World Interoperability for Microwave Access), and HSDPA (High Speed Downlink Packet Access).

The external device interface unit 350 provides an interface for connecting the signal measuring unit 300 to the image display device 100. For instance, the external device interface unit 350 allows the signal measuring unit 300 to perform a short-range wireless communication with the image display device 100. The signal measuring unit 300 may be connected to the image display device 100, according to communication standards such as Bluetooth, RFID (Radio Frequency Identification), IrDA (Infared Data Association), UWB (Ultra Wideband), Zigbee, DLNA (Digital Living Network Alliance).

According to one embodiment of the present invention, upon receipt of a control signal requesting for information on a user response to a scene being output, from the image display device 100 at certain time periods, the controller 330 generates information on a user's five-sense signals and/or bio-signals measured by the five-sense signal measuring unit 310 and/or the bio-signal measuring unit 320. Then, the controller 330 transmits the generated information to the image display device 100.

Classification of Emotional State

Figure 5:
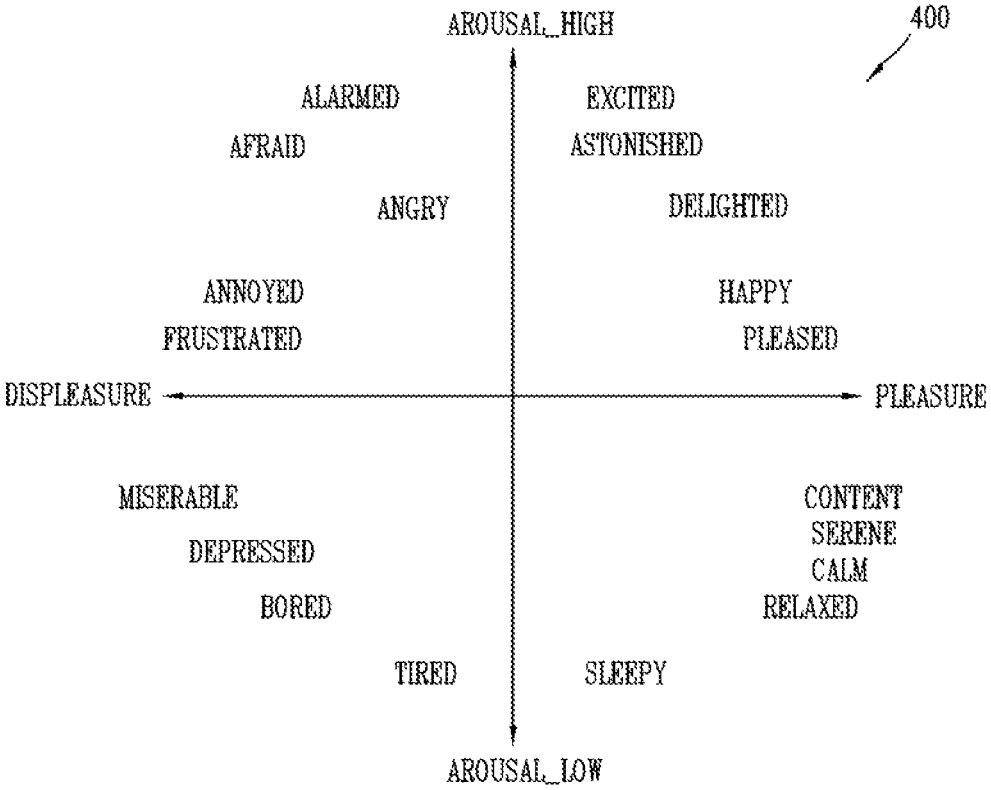
FIG. 5 is a view showing an emotional state classification model according to an embodiment of the present invention.

FIG. 5 is a view showing an emotional state classification model according to an embodiment of the present invention. In an embodiment, an emotional state classification model 400 indicates a 2-dimensional (2D) model where emotional states are mapped to particular coordinates having 'X' and 'Y' values. In the emotional state classification model 400, the 'X'-axis indicates the degree of pleasure and displeasure of a user, and the 'Y'-axis indicates the degree of arousal-high and arousal-low of a user. Accordingly, emotional states of a user are classified according to the degree of pleasure/displeasure and the degree of arousal-high/arousal-low.

In an embodiment, the image display device 100 receives, from the signal measuring unit 300, information on a user response to a scene being output, and determines the degree of pleasure, displeasure, arousal-high, and arousal-low of the user, based on the received information. Then, the image display device 100 determines an emotional state of the user, based on the determined degree of pleasure, displeasure, arousal-high, and arousal-low.

For instance, the image display device 100 stores data on the degree of pleasure, displeasure, arousal-high and arousal-low, according to five-sense signals and/or bio-signals of the user. In one embodiment, the data may be determined through experiments. Upon receipt of information on a user response to a scene being output, from the signal measuring unit 300, the image display device 100 calculates the degree of pleasure, displeasure, arousal-high, and arousal-low, using signal values included in the information on the user response, based on pre-stored data.

The image display device 100 applies the calculated degree of pleasure, displeasure, arousal-high, and arousal-low, to the emotional state classification model 400. In one embodiment, the image display device 100 determines an emotional state closest to the calculated pleasure, displeasure, arousal-high, and arousal-low applied to the emotional state classification model 400, as an emotional state of the user.

The emotional state classification model 400 of FIG. 5 is merely exemplary. Another emotional state classification model according to another embodiment may be applied to the present invention, the emotional state classification model capable of determining an emotional state of a user, based on information on a user response received from the signal measuring unit 300.

Structure of Content

FIG. 6 is a view showing a content structure according to an embodiment of the present invention.

Content 500 according to an embodiment of the present invention may include frames, a plurality of images, or a plurality of text pages, and the frames, the plurality of images, or the plurality of text pages may be displayed according to lapse of time, or according to a user's navigation command.

The content 500 may include at least one scene. Generally, the scene indicates a sight of a film or a play. In this specification, the scene indicates part of the content 500, such as one or more frames, images, or text pages. A single scene may include a single frame, or a plurality of frames. A single content 500 may include a single scene, or a plurality of scenes.

Identification information (A, B, C) may be added to a scene included in the content 500. The identification information indicates information for distinguishing a corresponding scene from other scenes. For instance, the identification information may be an ID including one or more characters and/or numbers. Alternatively, the identification information may be time stamps 510~560 corresponding to a starting point and an ending point of a scene.

Additional information may be connected to a scene included in the content 500. In this case, the additional information may be information on content associated with a scene being output, or information on a scene.

In a case where the additional information is information on content associated with a scene being output, the information on content may be content itself or detailed information on content. In a case where the additional information is information on a scene being output, the information on a scene may be a scene itself or detailed information on a scene.

According to an emotional state of a user for a scene being output from the image display device 100, other content or other scenes may be output from the image display device 100, or detailed information on other content or other scenes may be output from the image display device 100.

For example, in a case where a scene output from the image display device 100 is a movie trailer (preview), a movie associated with the movie trailer, or detailed movie information may be output according to an emotional state of a user. In a case where a scene output from the image display device 100 corresponds to identification information (A), a scene corresponding to identification information (B), or detailed information on a scene corresponding to the identification information (B) may be output according to an emotional state of a user.

Emotional State Analyzing Function

FIG. 7 is a flowchart showing processes for analyzing an emotional state of a user according to an embodiment of the present invention.

The controller 170 outputs, from content, a scene having identification information (S100). Upon receipt of a request for output of a scene having identification information from content, the controller 170 may read the requested scene from the storage unit 140, or may receive the requested scene via the broadcasting receiving unit 105 or the external device interface unit 135. Then, the controller 170 may output the read or received content to the display unit 180 and/or the audio output unit 185.

The controller 170 receives information on a user response to a scene being output (S200). Upon receipt of a request for information on a user response to a scene being output, the controller 170 may transmit a control signal to the signal measuring unit 300 at certain time intervals, thereby receiving, from the signal measuring unit 300, information on a user response to a scene being output.

The controller 170 determines an emotional state of the user, based on the information on the user response to the scene being output, the information received from the signal measuring unit 300 (S300).

For instance, the controller 170 may determine an emotional state of a user, based on information on a user's visual response received from the signal measuring unit 300. Alternatively, the controller 170 may determine an emotional state of a user, based on information on a user's audible response received from the signal measuring unit 300. Still alternatively, the controller 170 may determine an emotional state of a user, based on information on measured from the signal measuring unit 300, the information including information on a skin temperature, information on skin conductance, information on heartbeat variations, and information on brain waves on the prefrontal.

The controller 170 stores the determined emotional state of the user for the scene being output, in association with the identification information for the scene being output (S400). Upon receipt of a request for storage of an emotional state, the controller 170 stores, in the storage unit 140, the determined emotional state of the user for the scene being output, in association with the identification information for the scene being output. Alternatively, the controller 170 may generate taste information of the user based on the determined emotional state and the identification information for the scene, and store the generated taste information in the storage unit 140.

FIG. 8 is a view showing an emotional state recording table according to an embodiment of the present invention.

The emotional state recording table 600 includes identification information for a scene 610 and 620, and an emotional state of a user 630. The identification information for a scene 610 and 620 includes an ID 610 for distinguishing one scene from other scenes, or a time stamp 620.

For instance, referring to the emotional state recording table 600, scene (A) corresponds to a section, 00:12:00~00:13:30. While the scene (A) is being output, an emotional state of a user is 'relaxed'. Scene (B) corresponds to a section, 00:50:00~00:55:00. While the scene (B) is being output, an emotional state of a user is 'tired'. Scene (C) corresponds to a section, 01:20:00~01:30:00. While the scene (C) is being output, an emotional state of a user is 'excited'.

If the emotional state of the user for each scene is recorded in correspondence to each scene, the recorded emotional states may be utilized as various types of information. For instance, the emotional states may be provided to a user. Alternatively, additional information on each scene may be provided to a user based on the emotional states. Still alternatively, the recorded emotional states may be provided to a content provider.

Emotional State Output/Transmission Function

Figure 9:
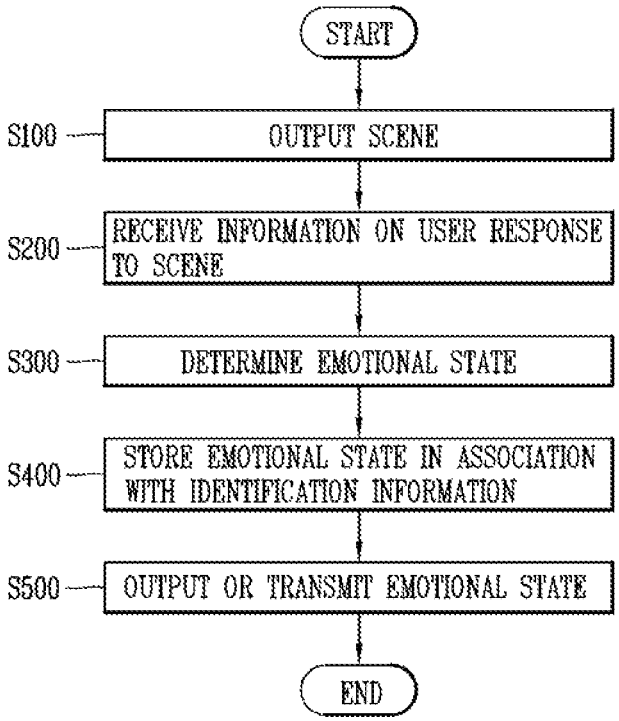
FIG. 9 is a flowchart showing processes for outputting an emotional state of a user according to an embodiment of the present invention.

FIG. 9 is a flowchart showing processes for outputting an emotional state of a user according to an embodiment of the present invention.

Steps S100~S400 have been aforementioned in FIG. 7, and thus detailed explanations thereof will be omitted.

Upon receipt of a request for output of an emotional state of a user for a scene being output, the controller 170 outputs the requested emotional state to the display unit 180 and/or the audio output unit 185. Alternatively, upon receipt of a request for transmission of an emotional state of a user for a scene being output, the controller 170 outputs the requested emotional state to the mobile terminal 200 (S500).

Figure 10:
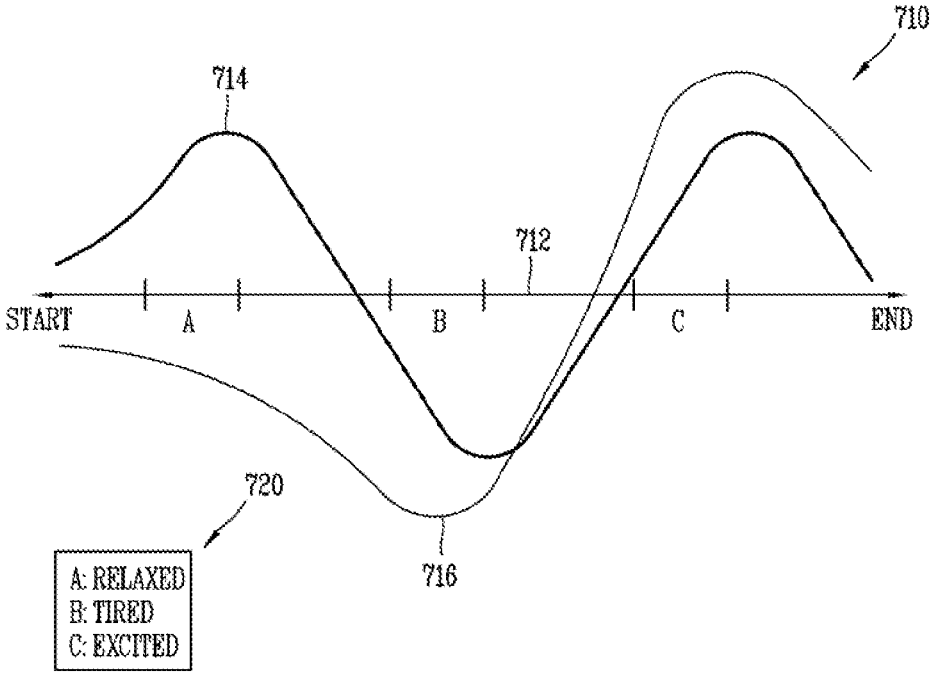
FIG. 10 is a view showing an emotional state outputting screen of an image display device 100 according to an embodiment of the present invention.

FIG. 10 is a view showing an emotional state outputting screen of the image display device 100 according to an embodiment of the present invention. The emotional state outputting screen includes a region 710 indicating the degree of pleasure, displeasure, arousal-high and arousal-low of a user for each time or each scene, in response to output content, and a region 720 indicating an emotional state of a user for each scene.

An item 714 indicating the degree of pleasure and displeasure of a user for each time or each scene, included in the region 710 indicating the degree of pleasure, displeasure, arousal-high and arousal-low of a user, visually shows the degree of pleasure and displeasure calculated based on a user response. An item 716 indicating the degree of arousal-high and arousal-low of a user for each time or each scene, visually shows the degree of arousal-high and arousal-low calculated based on a user response. In one embodiment, the upper side of a reference line 712 has a positive value and indicates the degree of pleasure (or arousal-high), whereas the lower side of a reference line 712 has a negative value and indicates the degree of displeasure (or arousal-low).

The region 720 indicating an emotional state of a user for each scene, shows identification information for each scene, and an emotional state for each scene. In one embodiment, the region 720 indicating an emotional state of a user for each scene, may further include detailed information on each scene.

Additional Information Output/Transmission Function

Figure 11A:
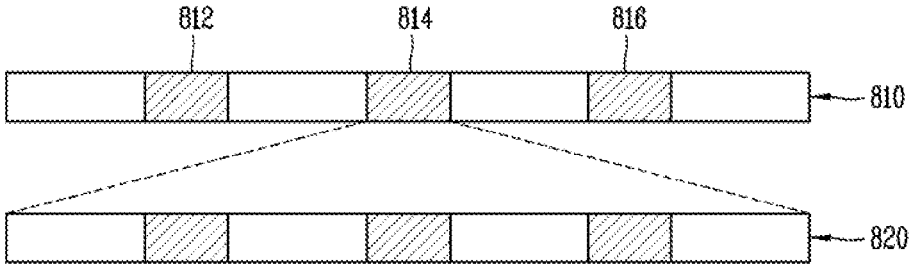
FIGS. 11A and 11B are views showing a content structure where additional information is connected to a scene according to an embodiment of the present invention.
Figure 11B:
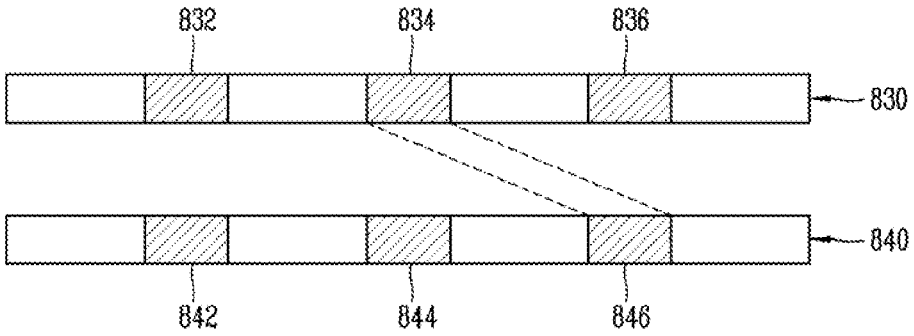

FIGS. 11A and 11B are views showing a content structure where additional information is connected to a scene according to an embodiment of the present invention.

Referring to FIG. 11A, content 810 may include one or more scenes 812, 814 or 816. The scene 814 may be connected to additional information on a scene, and the additional information may be information on content 820. Here, the content 820 may be the same as the content 810, or may be different from the content 810. Alternatively, the information on the content 820 may be information on advertisement content.

Referring to FIG. 11B, content 830 may include one or more scenes 832, 834 or 836. The scene 834 may be connected to additional information on a scene, and the additional information may be information on a scene 846 included in content 840. Here, the content 830 may be the same as the content 840, or may be different from the content 840. Alternatively, the information on the scene 846 may be information on advertisement content.

Figure 12:
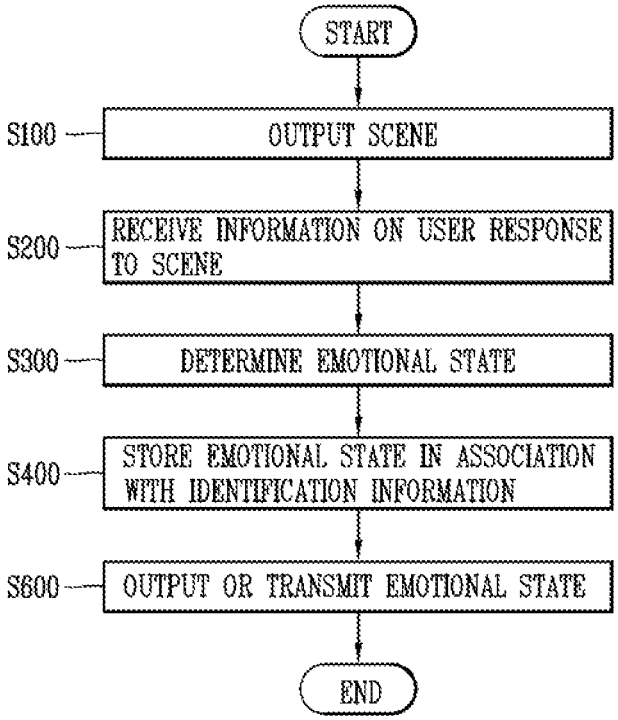
FIG. 12 is a flowchart showing processes for outputting additional information according to an embodiment of the present invention.

FIG. 12 is a flowchart showing processes for outputting additional information according to an embodiment of the present invention.

Steps S100~S400 have been aforementioned in FIG. 7, and thus detailed explanations thereof will be omitted.

Upon receipt of a request for output of additional information connected to a scene being output, the controller 170 may output the requested additional information to the display unit 180 and/or the audio output unit 185. Alternatively, upon receipt of a request for transmission of additional information connected to a scene being output, the controller 170 outputs the requested additional information to the mobile terminal 200 (S600).

Figure 13:
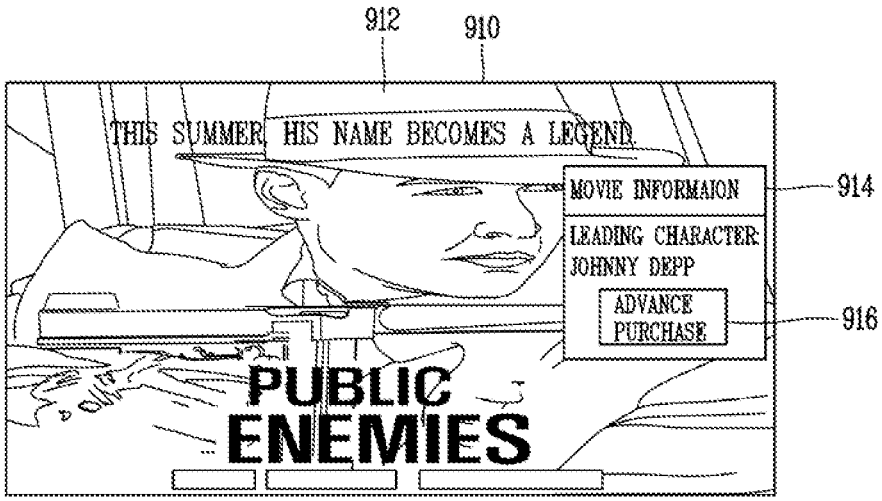
FIG. 13 is a view showing an additional information outputting screen according to an embodiment of the present invention.

FIG. 13 is a view showing an additional information outputting screen according to an embodiment of the present invention.

The additional information outputting screen 910 includes a first region 912 for outputting a scene, and a second region 914 for outputting additional information. On the additional information, the second region 914 may be displayed outside the first region 912. For instance, the second region 914 may be displayed close to the first region 912. Alternatively, the second region 914 may be displayed in an overlapping manner with the first region 912. For instance, the first region 912 may be displayed as a full screen, and the second region 914 may be displayed in an inserted manner into the first region 912. In this case, a technique called Picture-in-Picture (PiP) may be used.

The second region 914 may further include content associated with additional information, or a link item 916 associated with an application. Once the link item 916 is selected by a user, content corresponding to the link item 916 may be output, or an application may be executed.

Referring to FIG. 13, displayed is movie information on a scene of a movie trailer. The scene of a movie trailer is displayed as a full screen, and the movie information is displayed in an inserted manner into the scene. The movie information further includes a link for purchasing a movie ticket in advance.

Figure 14:
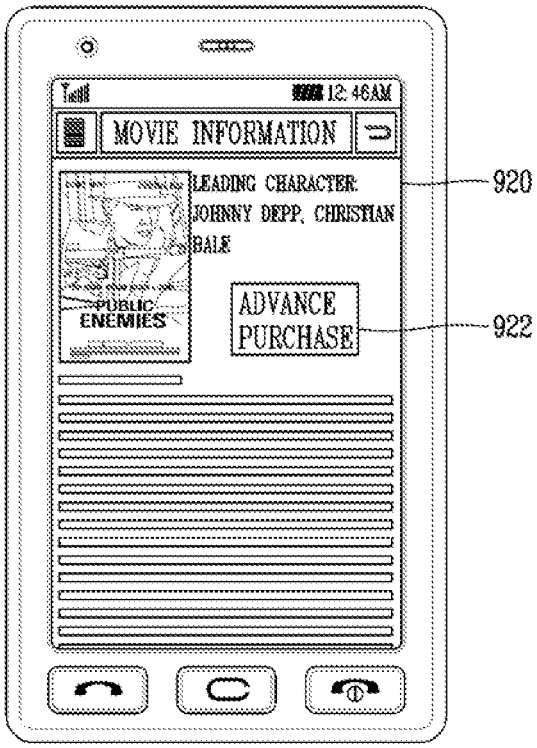
FIG. 14 is a view showing an additional information outputting screen of a mobile terminal according to an embodiment of the present invention.

FIG. 14 is a view showing an additional information outputting screen of a mobile terminal according to an embodiment of the present invention.

Additional information received from the image display device 100 is displayed on the additional information outputting screen 920. The additional information outputting screen 920 may further include content associated with additional information, or a link item 922 associated with an application. Once the link item 922 is selected by a user, content corresponding to the link item 922 may be output, or an application may be executed.

Referring to FIG. 14, displayed is movie information on a scene of a movie trailer. The movie information further includes a link for purchasing a movie ticket in advance.

Setting Function

Figure 15:
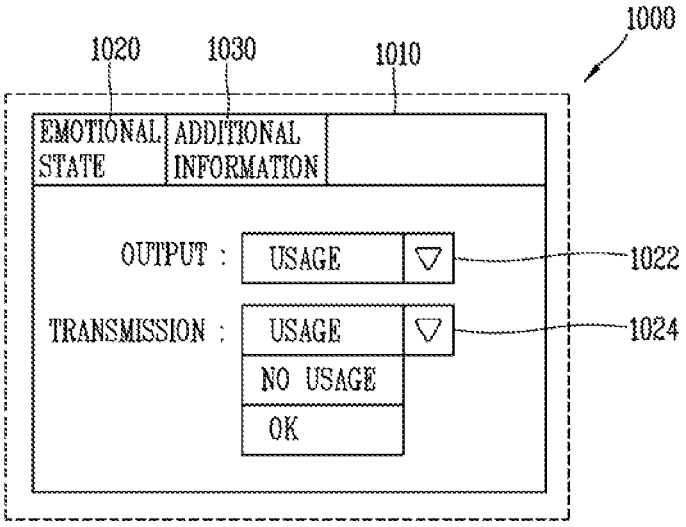
FIG. 15 is a view showing a setting screen with respect to output/transmission of an emotional state and additional information according to an embodiment of the present invention.

FIG. 15 is a view showing a setting screen with respect to output/transmission of an emotional state and additional information according to an embodiment of the present invention.

The setting screen 1000 with respect to output/transmission, includes a region 1010 for setting about whether or not to output and whether or not to transmit an emotional state and additional information. The region 1010 includes an emotional state tap 1020 and an additional information tap 1030. Once the emotional state tap 1020 or the additional information 1030 is selected, displayed are an item 1022 for setting about whether or not to output an emotional state or additional information, and an item 1024 for setting about whether or not to transmit an emotional state or additional information. The item 1022 for setting about whether or not to output an emotional state or additional information, includes 'Usage'. And, the item 1024 for setting about whether or not to transmit an emotional state or additional information, includes 'Usage', 'No Usage' and 'OK'.

If the item 1022 or 1024 is set as 'Usage', an emotional state or additional information is automatically output. On the other hand, if the item 1022 or 1024 is set as 'No Usage', an emotional state or additional information is not output. If the item 1022 or 1024 is set as 'OK', an emotional state or additional information is output or is not output according to whether a user has checked or not.

Under such configurations, the controller 170 may check an output setting and/or a transmission setting with respect to an emotional state, and may output an emotional state and/or may transmit an emotional state to the mobile terminal based on the output setting and/or the transmission setting. Alternatively, the controller 170 may check an output setting and/or a transmission setting with respect to additional information. The, the controller 170 may output additional information and/or may transmit additional information to the mobile terminal, based on the output setting and/or the transmission setting, and the determined emotional state.

The invention claimed is:

1. A method for analyzing an emotional state of a user in an image display device, the method comprising:

displaying a scene from content, the scene including identification information and related additional information;

receiving information related to a user response to the displayed scene;

determining an emotional state of the user based on the received information;

storing the determined emotional state such that it is associated with the identification information; and displaying the additional information on the scene based on the emotional state such that different additional information is displayed according to different emotional states.

2. The method of claim 1, further comprising outputting the determined emotional state.

3. The method of claim 2, wherein outputting the determined emotional state comprises:

determining at least an output setting or a transmission setting related to the emotional state outputting the emotional state based on the at least output setting or transmission setting.

4. The method of claim 1, wherein displaying the additional information comprises:

determining an output setting related to the additional information; and displaying the additional information based on the output setting and the emotional state.

5. The method of claim 1, wherein the additional information is content associated with the scene or information related to the scene.

6. The method of claim 5, wherein additional information is advertisement content.

7. The method of claim 1, wherein the received information includes information related to at least a visual response or an audible response.

8. The method of claim 1, wherein the received information includes at least a user's skin temperature, a user's skin conductance, a user's heartbeat variations or a user's brain wave signal.

9. The method of claim 1, wherein the information is received from a remote controller of the user.

10. The method of claim 1, wherein determining the emotional state of the user comprises:

determining a degree of the user's pleasure, the user's displeasure, the user's high-arousal or the user's low-arousal based on the received information; and determining the emotional state of the user based on the degree of the user's pleasure, the user's displeasure, the user's high-arousal or the user's low-arousal.

11. The method of claim 1, wherein the identification information includes information related to a time stamp of the scene.

12. The method of claim 1, further comprising:

generating taste information of the user based on the determined emotional state and the identification information; and storing the generated taste information.

13. An image display device, comprising:

an output unit configured to display a scene from content, the scene having identification information and related additional information;

a communication unit configured to receive information related to a user response to the displayed scene; and a controller configured to determine an emotional state of the user based on the received information, store the determined emotional state such that it is associated with the identification information, and display the additional information on the scene based on the emotional state such that different additional information is displayed according to different emotional states.

14. An image display system, comprising:

a remote device configured to transmit information; and an image display device configured to display information, the image display device comprising:

an output unit configured to display a scene from content, the scene having identification information and related additional information;

a communication unit configured to receive information related to a user response to the displayed scene from the remote device; and a controller configured to determine an emotional state of the user based on the received information, store the determined emotional state such that it is associated with the identification information, and display the additional information on the scene based on the emotional state such that different additional information is displayed according different emotional states.

15. The method of 4, wherein the additional information is content associated with the scene or information related to the scene.

16. The method of claim 15, wherein additional information is advertisement content.

17. The image display device of claim 13, wherein the controller is further configured to:

determine an output setting related to the additional information; and display the additional information based on the output setting and the emotional state.

18. The image display device of claim 13, wherein the controller is further configured to:

determine a degree of the user's pleasure, the user's displeasure, the user's high-arousal or the user's low-arousal based on the received information; and determine the emotional state based on the degree of the user's pleasure, the user's displeasure, the user's high-arousal or the user's low-arousal.

19. The image display system of claim 14, wherein the controller is further configured to:

determine an output setting related to the additional information; and display the additional information based on the output setting and the emotional state.

20. The image display device of claim 14, wherein the controller is further configured to:

determine a degree of the user's pleasure, the user's displeasure, the user's high-arousal or the user's low-arousal based on the received information; and determine the emotional state based on the degree of the user's pleasure, the user's displeasure, the user's high-arousal or the user's low-arousal.

* * * * *